US005662969A

United States Patent [19]

Ling

[11] Patent Number: 5,662,969

[45] Date of Patent: Sep. 2, 1997

[54] HOT COATING BY INDUCTION LEVITATION

[75] Inventor: Ping Ling, Yagoona, Australia

[73] Assignee: Graham Group, Yagoona, Australia

[21] Appl. No.: 687,534

[22] PCT Filed: Jan. 25, 1995

[86] PCT No.: PCT/AU95/00040

§ 371 Date: Jul. 26, 1996

§ 102(e) Date: Jul. 26, 1996

[87] PCT Pub. No.: WO95/20684

PCT Pub. Date: Aug. 3, 1995

[30] Foreign Application Priority Data

Jan. 31, 1994 [AU] Australia ..... PM3606

[51] Int. Cl.[6] ..... H05B 6/02

[52] U.S. Cl. ..... 427/591; 118/405; 118/419; 118/423; 118/429; 118/500; 118/600; 118/623; 118/665; 118/667; 118/693; 118/712; 427/8; 427/318; 427/320; 427/321; 427/349; 427/398.3; 427/434.2; 427/436; 427/543; 427/549; 427/598

[58] Field of Search ..... 427/591, 8, 318, 427/320, 321, 349, 398.3, 434.2, 436, 543, 549, 598; 118/405, 419, 423, 429, 500, 600, 623, 665, 667, 693, 712

[56] References Cited

PUBLICATIONS

Derwent Abstract Accession No. 90–13104/17, Class X25, SU,A. 149253, Hardware Ind. Res, Jul. 15, 1989.

Patent Abstracts of Japan, C45, p. 158, JP, A, 54–32135, Asahi Glass KK, Sep. 3, 1979.

Derwent Abstract Acession No. 44118C/25, Class M 13, JP, A,. 55–062153, Nippon Steel Corp. 10 May 1980.

Derwent Abstract Acession No. 79927B/44, Class M13, JP, A, 54–122640; Kube Steel KK, 22 Sep. 1979.

Patent Abstract of Japan, C61, p. 52, JP, A, 54–102247; Kobe Seikosho KK; 8 Nov. 1979.

Patent Abstract of Japan, C66, p. 49, JP, A, 54–124836; Asahi Glass KKO; 28 Sep. 1979.

Derwent Abstract Accession No. 32425E/16, Class M13, JP, A, 82–015664; Mitsubishi Heavy Ind KK; 31 Mar. 1982.

*Primary Examiner*—Bernard Pianalto

*Attorney, Agent, or Firm*—Darby & Darby

[57] ABSTRACT

A coating apparatus and method for applying a coating to a workpiece, comprising:

a vessel to contain molten metal;

an induction coil disposed about said vessel; and, temperature regulation means;

wherein, in use, said induction coil induces a magnetic field within said vessel such that a meniscus of molten metal is formed above said vessel, through which said workpiece is passed for coating, whilst said temperature regulation means regulates temperature of said molten metal and/or controls the meniscus height of said meniscus.

15 Claims, 3 Drawing Sheets

HOT COATING BY INDUCTION LEVITATION

FIELD OF THE INVENTION

The invention pertains to a method and apparatus for coating a workpiece, such as in the process of galvanising, and more particularly, to an in-line galvanising process utilising a coreless induction furnace which develops a meniscus of liquid metal. In particular, the invention relates to the selection of desirable parameters to consequently control the meniscus.

BACKGROUND OF THE INVENTION

Galvanisation of steel sheet, strip, wire or odd shaped steel members is a well known process. There are several known methods, particularly in relation to continuous rigid members in the galvanising industry for in-line processing. However, a difficulty associated with the prior art methods is the requirement of one or more pumping devices for transporting the liquid metal coating from a melting vessel to a galvanising chamber, either directly or indirectly through a holding vessel. Further, with regard to in-line galvanising processes where material is introduced into the galvanising chamber continuously, there needs to be means for preventing molten metal from leaking outside the galvanising chamber. These means are known to take the form of either electromagnetic seals or secondary chambers which house the galvanising chamber so that molten metal is collected in the secondary chamber for eventual return to the holding vessel or melting vessel. Another common prior art method is the trough method, where rigid material is required to be bent or deflected down into a galvanising pot and then slanted upwards thereafter.

Whilst these prior art approaches attempt to improve the operational efficiency and are space saving, they are far from an adequate and economical solution. Recent prior art has considered the use of an induction heating coil to pre-heat the work before entering the galvanising chamber, and the use of electro-magnetic seal rings to prevent the liquid escaping from the galvanising chamber. However, auxiliary equipment is still required, including, a vessel for the purposes of melting zinc or aluminium ingot, a mechanical or electro-magnetic pump to pump the molten zinc/aluminium to the galvanising chamber, and a heating element to maintain galvanising temperature.

As will be appreciated, therefore, there have been various attempts to achieve a successful in-line galvanising of straight products without subjecting them to bending.

SUMMARY OF THE INVENTION

The present invention seeks to provide an apparatus and method for coating a workpiece, such as in galvanising, which apparatus and method substantially ameliorates the disadvantages associated with prior art methods and devices.

In one broad form, the present invention provides a coating apparatus, for applying a coating to a workpiece, comprising:

a vessel to contain a molten metal; and, an induction coil disposed about said vessel;

wherein, in use, said induction coil induces a magnetic field within said vessel such that a meniscus of molten metal is formed above said vessel, through which said workpiece is passed for coating.

In a further broad form, the present invention provides a method for applying a coating to a workpiece, comprising the steps of:

forming a meniscus above a vessel containing molten metal by creating a magnetic field to effect said molten metal; and passing said workpiece through said meniscus such that a coating is formed on said workpiece.

Preferably, the present invention enables the power, current, voltage and/or frequency within said induction coil to be controlled to produce a predetermined magnetic field in said molten metal and to consequently create a meniscus of predetermined height.

Also preferably, the composition, temperature and/or density of the molten metal is chosen to create a meniscus of predetermined height.

In preferred forms, said workpiece is formed of ferrous or non-ferrous material.

Also in preferred forms, said workpiece is commercial grade, low carbon steel.

Perhaps most preferably, said molten metal comprises zinc or an aluminium zinc mixture.

In a preferred embodiment, said apparatus further comprises temperature regulation means to regulate temperature of said molten metal and/or control meniscus height.

Perhaps most preferably said temperature regulation means comprises a fluid cooled regulation means.

In a most preferred form said fluid cooled regulation means comprised an air or water cooled plate member constructed of copper, ferrous material or the like, provided within or adjacent a surface of said vessel.

In a preferred embodiment said apparatus further comprises transport means, such as rollers, to transport said workpiece through said meniscus.

Preferably, prior to passing said workpiece through said meniscus, said workpiece is preheated.

Also preferably, after coating of said workpiece, said workpiece undergoes air or nitrogen wiping or the like.

In a preferred arrangement feed rollers provided on either side of said vessel to assist in closure or said meniscus.

BRIEF DESCRIPTION OF THE DRAWINGS

The present invention will become more fully understood from the following description of a preferred but non-limiting embodiment thereof, described in connection with the accompanying drawings, wherein.

DETAILED DESCRIPTION OF PREFERRED EMBODIMENT(S)

Figure 1:
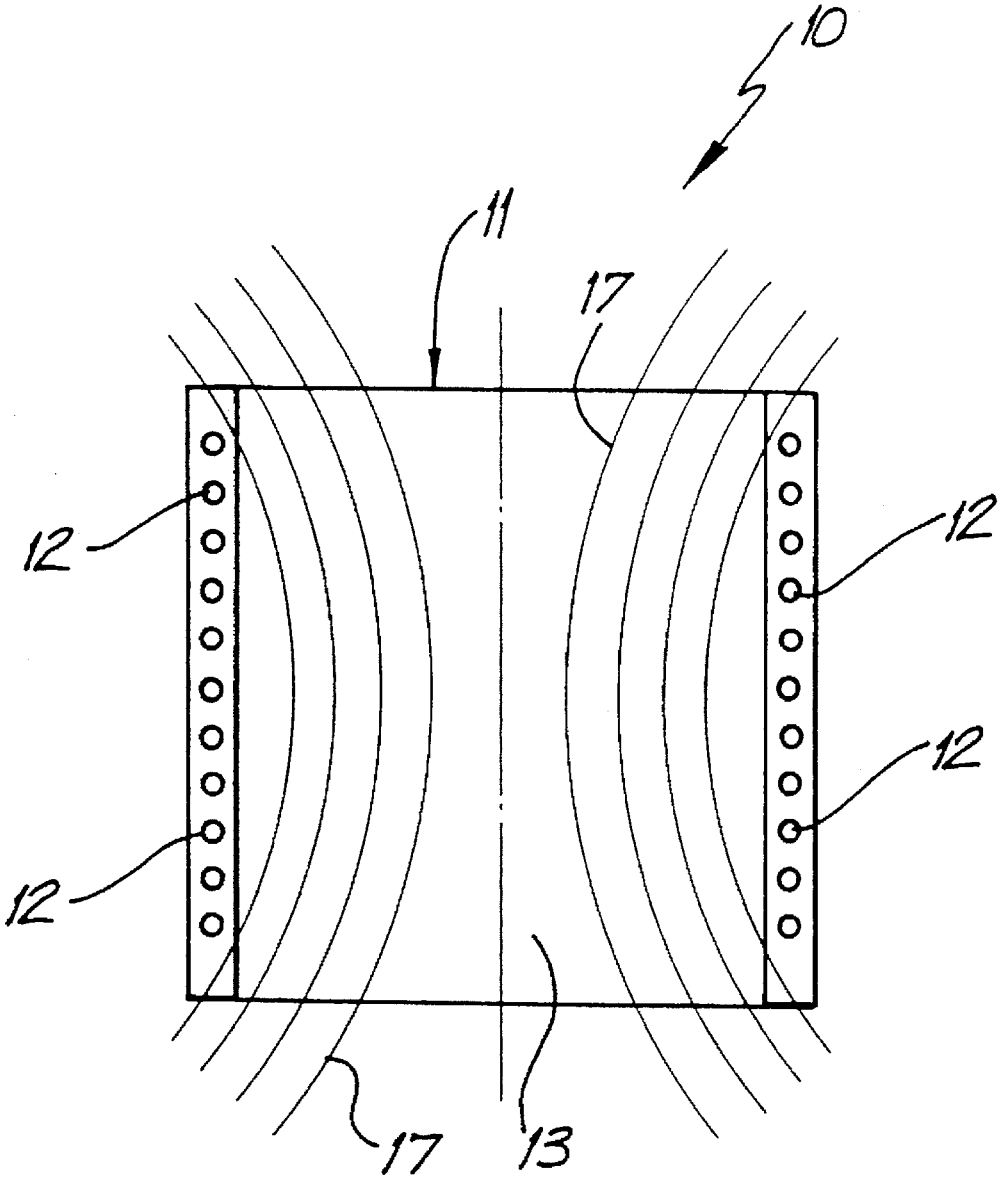
FIG. 1 is a schematic cross section depicting the magnetic field produced by a cylindrical coil in a coreless induction furnace.

As shown in FIG. 1, a coreless induction furnace 10 incorporates a vessel 11 around which a coil 12 is located.

The magnetic field associated with the coil 12 when current flows through it, passes through the inside 13 of the coil 12 and thus into the interior of the vessel 11, as shown in FIG. 1, the lines of magnetic force being indicated by the numeral 17. The field density is highest at the inside 13 of the coil 12. A proportion of the magneto-motive force is however used by the external field. This proportion is given by Nagaoka's coefficient, which coefficient gives the ratio of the flux created by the coil to that which would have been produced if the external magnetic resistance had been zero such as would be obtained for instance by fitting the coil with an external magnetic circuit.

The presence of an external magnetic circuit results in the reinforcement and even distribution of the field inside the coil. Thus, a coreless induction furnace according to the teachings of the present invention, preferably includes an outer magnetic screen which serves the purpose of maximising the reinforcement of the magnetic field inside the coil so as to provide an increase in the stirring motion imparted on the liquid contents of the furnace.

Figure 2:
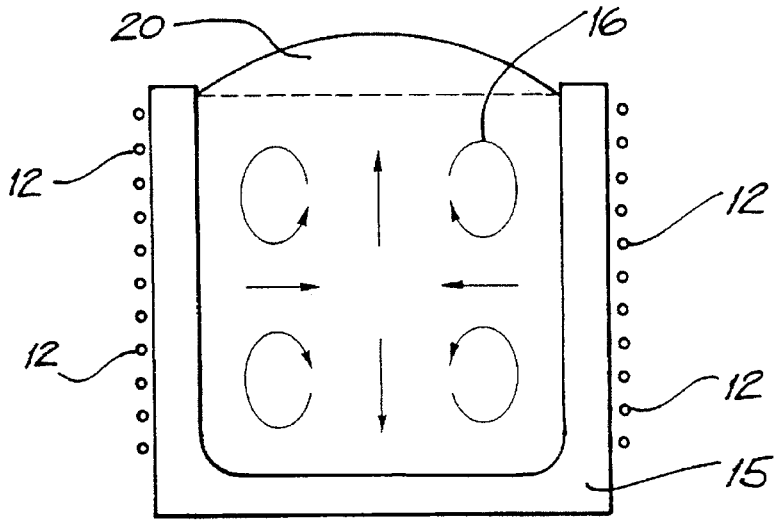
FIG. 2 is a schematic cross section illustrating the circulation of liquid metal within the induction furnace depicted in FIG. 1.

Thus it will be appreciated, as depicted in FIG. 2, that there will be movement or circulation of liquid metal within the crucible 15 as suggested by the motion indicating arrows 16. Because the coil and the circulating molten metal carry currents in opposite directions, there is a mutual repulsion between the coil 12, which is, fixed and the liquid metal 16, which is free to move. The metal is pushed away from the coil in the centre of the vessel and returned to the outside at the top and bottom surfaces or ends, thus giving a circulation pattern exemplified in a crude schematic way by the diagram of FIG. 2.

However, this very circulatory motion depicted by arrows 17 results in a meniscus 20. For a given power induced in the melt, the height of the meniscus 20 is inversely proportional to the square root of the frequency. Therefore, the lower the frequency the more vigorous the stirring action.

Where metal is melted with a coreless induction furnace, the mixing action provided by the effect of the coil assists in the assimilation of alloying additions and helps promote uniform heating. Of course, where the stirring effect is overly violent or vigorous, and refractory erosion may becomes excessive, slag particles can be incorporated into the metal and increased gas absorption may occur.

Figure 3:
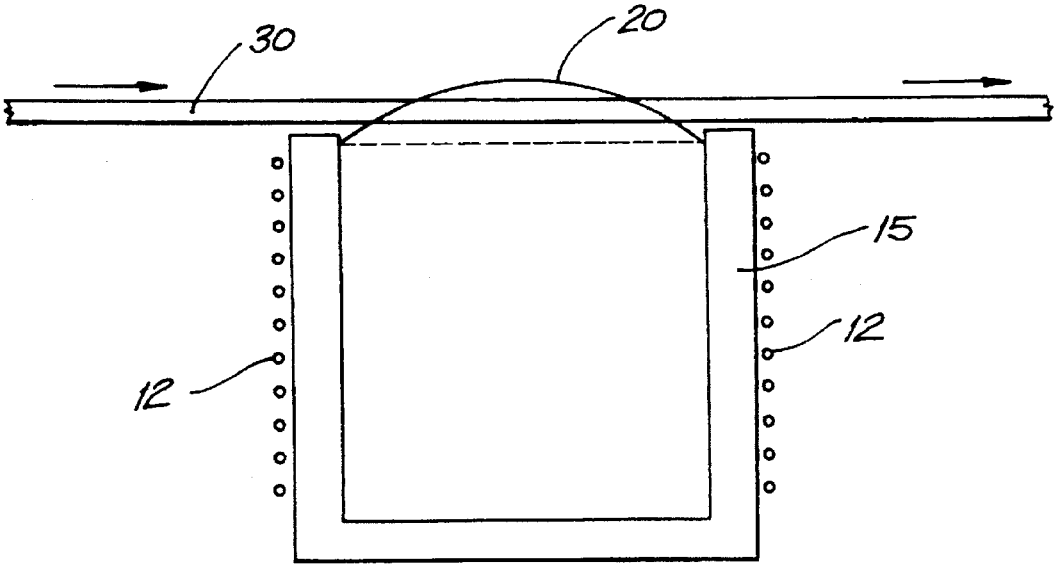
FIG. 3 is a schematic cross sectional view of an induction furnace as depicted in FIG. 1, further illustrating the passage of a work-piece through a meniscus which develops above the molten galvanising material within the furnace.

The present invention utilises of the meniscus 20 to assist in a continuous galvanising process. As shown in FIG. 3, a work-piece 30 of practically any cross sectional configuration can be passed through the meniscus 20.

The present invention also recognises and takes advantage of the fact that, by the inherent nature of a meniscus, the molten ferrous and/or non-ferrous material will not be able to escape (leak) from the opening at the side of the furnace where the workpiece enters and exits during galvanising process.

Figure 4:
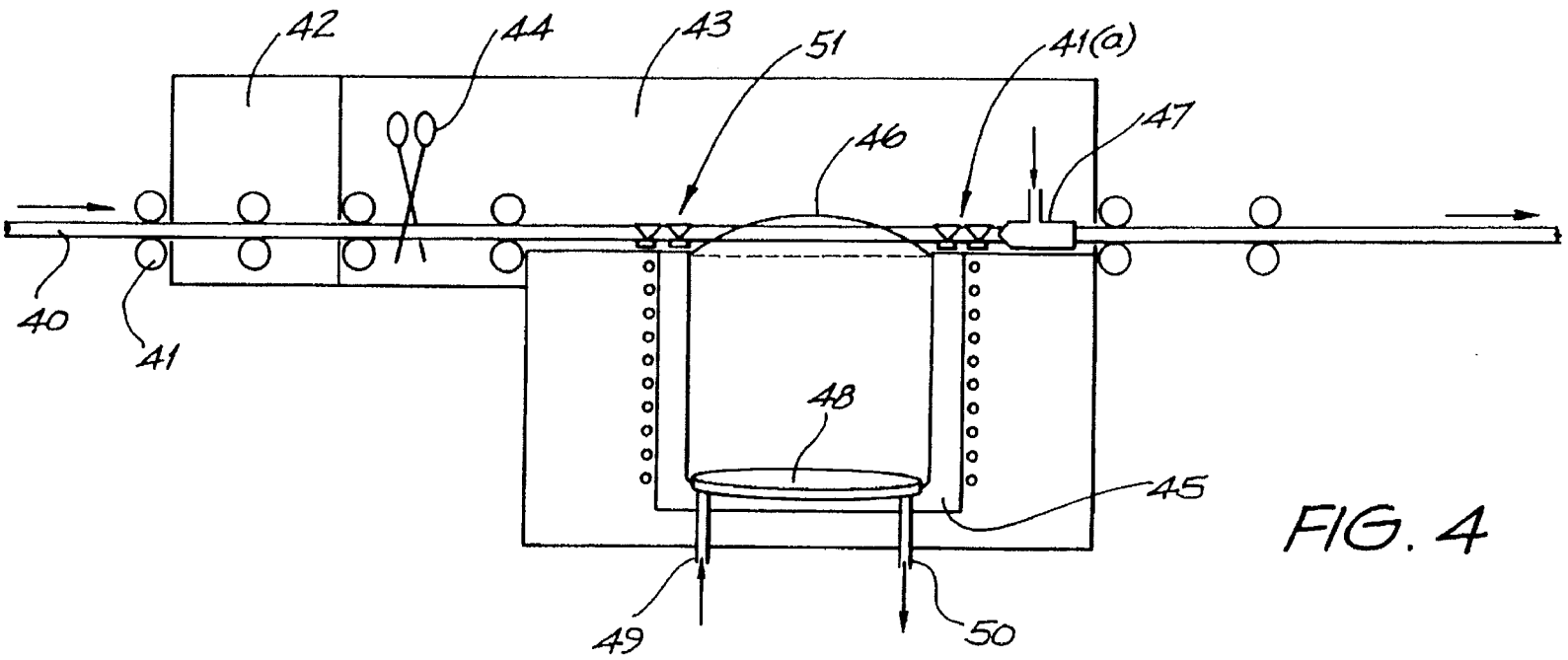
FIG. 4 shows a furnace similar to that depicted in FIG. 3, but also illustrating other system components to pre-heat and post-treat the workpiece.

A more detailed schematic view of a continuous galvanising process is depicted in FIG. 4. The process begins when uncoated material 40 is introduced, by feed rollers 41 into a pre-treatment area 42, if required. The pre-treatment area 42 may incorporate shot blasting, sand blasting or chemical cleansing. The work-pieces 30 may be preheated or coated with flux where required. Preferably, the work-piece 30 proceeds into a treatment chamber 43 in which is maintained an inert or reducing atmosphere. Continuous material stock 40 may be cut to length at a cutting station 44 prior to galvanisation. Within the furnace 45 liquid zinc or an aluminium zinc alloy is circulated, as discussed above, to form a meniscus 46. The work-piece 40 may be advanced by drive rollers 51 through the liquid metal meniscus 46 and then into an air or gas wiping station 47.

Figure 5:
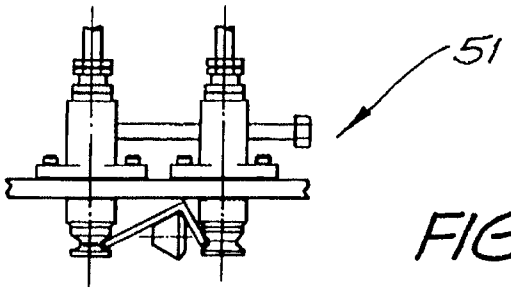
FIG. 5 details specially adapted feed rollers which may be used to close either side of the meniscus.

As shown in FIG. 5, specially adapted vertical feed rollers 51 may be used close to the meniscus and on either side of the meniscus 46.

In the example of FIG. 4, the work-piece would typically be a commercial grade, low carbon steel, but could of course be any ferrous or non-ferrous material. The workpiece is fed from a roll-in table into the shot blasting or cleaning area. The cleaned work-piece is advanced through the pinch-rollers 41 to the flying shear 44 which is located within the inert or reducing atmosphere of the enclosure. Induction preheating coils may be used to elevate the temperature of the work-piece if a faster throughput is desired. Preheat temperatures could range from below to above galvanising temperature. The coating material within the induction furnace is preferably heated to approximately 380° C. to 750° C., depending on the alloy being used. For zinc, a meniscus height of approximately 259 mm is typical, whilst for an alloy of 55% aluminium and 45% zinc the meniscus height of approximately 495 mm is typical. After exiting the meniscus, the pinch-roller 51 advances the work-piece through a station 47 for air or nitrogen wiping before the piece proceeds to the roll-out table and then onward to bundling.

As shown in FIG. 4, a cooling means, such as a water cooled or air cooled disc shape copper plate 48, or plate made from any ferrous material may be installed at the bottom of the furnace or at the side of the furnace, either below or above the refractory or ceramic insulation material. Cooling media, such as water may be supplied into inlet 49 and out through outlet 50. This is for the purpose of controlling run-away temperature when power is required to maintain the meniscus height, at the same time, obtaining a steady galvanising temperature. Depending on the coating alloy used, galvanising temperature may be in the order of 380° C. to 750° C.

Thus, it will be appreciated that the electric coreless induction furnace of the present invention is similar to a transformer in which the primary winding is a multiple turn coil and the secondary winding is a single loop consisting of the molten or liquid ferrous or non-ferrous charge within the vessel. In all coreless furnaces, the charge is contained in a refractory crucible surrounded by an insulated helical coil. The crucible is in general formed by ramming a granular refractory material between the coil and a hollow metal former which is melted away in the first heat. Acid lining is often used as it is cheaper and thermally more efficient. In the present invention, specific attention is directed towards creating a high meniscus height at the desired galvanising temperature.

The preferred furnace shapes are round or oval in cross section. The convention induction furnace coil frequency ranges from about 50 hertz to about 1000 hertz, however, the design of the present invention includes the ranges from about 10 hertz to 50 hertz. A preferred furnace capacity ranges from about 300 to about 5000 kilos. Power levels of about 20 and 4000 kilowatts permit development of a meniscus height of about 20 to 1400 mm for zinc. It is expected that a 55% aluminium, 45% zinc alloy would develop a meniscus height of about 1800 mm.

Meniscus is defined as the height of the liquid metal dome which forms in the centre of the furnace vessel. The centre height is greater than the height at the edges. Stirring is defined by the ratio of the meniscus height to the bath diameter (h/D). The higher the power, the lower the frequency and the lower the metal density, the greater the meniscus height. The (h/D) ratio is also affected by the diameter of the furnace. Therefore, at a set frequency, a higher power can be applied to a large furnace to achieve the same stirring level as a smaller furnace operating at a lesser power.

It will be appreciated that the invention also allows expensive pinch-rollers to be done away with. The pinch rollers are normally made from stainless steel 316L and must be located inside the galvanising chamber or pot. The risk of damage or breakage to pinch rollers operating within the galvanising pot is considerable. Within the context of the present invention, these pinch rollers can be eliminated.

Thus, while the invention has been described with reference to particular details of construction, these should be understood as having been provided by way of example and not as limitations to the scope of the invention. All variations and modifications which become apparent to persons skilled in the art should be considered to be encompassed by the invention as broadly hereinbefore described and as hereinafter claimed.

I claim:

1. A coating apparatus, for applying a coating to a workpiece, comprising:

a vessel to contain a molten metal;

an induction coil disposed about said vessel; and, temperature regulation means;

wherein, in use, said induction coil induces a magnetic field within said vessel such that a meniscus of molten metal is formed above said vessel, through which said workpiece is passed for coating, whilst said temperature regulation means regulates temperature of said molten metal and/or controls the meniscus height of said meniscus.

2. A coating apparatus as claimed in claim 1, wherein the power, current, voltage and/or frequency within said induction coil is controlled to produce a predetermined magnetic field in said molten metal and to consequently create a meniscus of predetermined height.

3. A coating apparatus as claimed in claim 2, wherein the composition, temperature or density of the molten metal is chosen to create a meniscus of predetermined height.

4. A coating apparatus as claimed in claim 1, wherein said workpiece is formed of ferrous or non-ferrous material.

5. A coating apparatus as claimed in claim 4, wherein said workpiece is commercial grade, low carbon steel.

6. A coating apparatus as claimed in claim 1, wherein said molten metal comprises zinc or an aluminum zinc mixture.

7. A coating apparatus as claimed in claim 1, wherein said temperature regulation means comprises a fluid cooled regulation means.

8. A coating apparatus as claimed in claim 7, wherein said fluid cooled regulation means comprises an air or water cooled plate member constructed of copper, ferrous material or the like provided within or adjacent a surface of said vessel.

9. A coating apparatus as claimed in claim 1, wherein prior to passing said workpiece through said meniscus, said workpiece is preheated.

10. A coating apparatus as claimed in claim 9, wherein after coating of said workpiece, said workpiece undergoes air or nitrogen wiping or the like.

11. A coating apparatus as claimed in claim 1, wherein the composition, temperature or density of the molten metal is chosen to create a meniscus of predetermined height.

12. A coating apparatus as claimed in claim 1, further comprising feed rollers provided on either side of said vessel to assist in closure of said meniscus.

13. A coating apparatus as claimed in claim 1, further comprising transport means, such as rollers, to transport said workpiece through said meniscus.

14. A coating apparatus as claimed in claim 13, wherein after coating of said workpiece, said workpiece undergoes air or nitrogen wiping.

15. A method for applying a coating to a workpiece, comprising the steps of:

forming a meniscus of controlled height above a vessel containing molten metal by creating a magnetic field to effect said molten metal and by regulating the temperature of said molten metal; and passing said workpiece through said meniscus such that a coating is formed on said workpiece.

* * * * *